United States Patent [19]

Gallagher

[11] 4,441,882

[45] Apr. 10, 1984

[54] CONTINUOUS LAUNDERING METHOD

[76] Inventor: Paul H. Gallagher, 2530 Crawford Ave., Evanston, Ill. 60201

[21] Appl. No.: 374,935

[22] Filed: May 5, 1982

Related U.S. Application Data

[63] Continuation-in-part of Ser. No. 141,952, Apr. 21, 1980, Pat. No. 4,361,018.

[51] Int. Cl.[3] ..... D06F 15/00

[52] U.S. Cl. ..... 8/150; 8/159; 68/22 R; 68/27; 68/43; 68/53; 68/158

[58] Field of Search ..... 8/147, 150, 159; 68/10, 68/11, 22 R, 27, 43, 44, 45, 53, 96, 148, 158, 177; 198/819

[56] References Cited

U.S. PATENT DOCUMENTS

| | | | |
|---|---|---|---|
| 3,292,397 | 12/1966 | Wooliever | 68/158 X |
| 3,442,369 | 5/1969 | Harkess | 198/819 X |
| 3,693,382 | 9/1972 | Grantham | 68/158 X |
| 3,744,277 | 7/1973 | Grantham | 68/53 |
| 3,999,646 | 12/1976 | Yoshida | 198/819 X |

FOREIGN PATENT DOCUMENTS

| | | | |
|---|---|---|---|
| 1148181 | 5/1963 | Fed. Rep. of Germany | 198/819 |
| 1427226 | 12/1965 | France | 68/10 |

*Primary Examiner*—Philip R. Coe

*Attorney, Agent, or Firm*—Paul H. Gallagher

[57] ABSTRACT

Continuous laundering apparatus having a continuous conveyor carrying the goods to be laundered through the apparatus. Devices additional to, and separate from, the conveyor are provided for agitating the goods as they are carried by the conveyor. The conveyor positively carries the goods, including in one form, opposed elements confining the goods therebetween and in another form a single element on which the goods rest. The agitating means includes selectively (a) rollers which are free turning, and turn by engagement therewith by the conveyor and compress the goods between the rollers and a reaction plate; (b) plungers or pushers which are positively driven against the goods, compressing them against the reaction plate; and (c) grippers on opposite sides of the conveyor gripping the conveyor, and thus the goods, between them. A plurality of laundering units are arranged in serial attitude to accommodate different kinds of laundering steps in a continuous operation.

8 Claims, 35 Drawing Figures

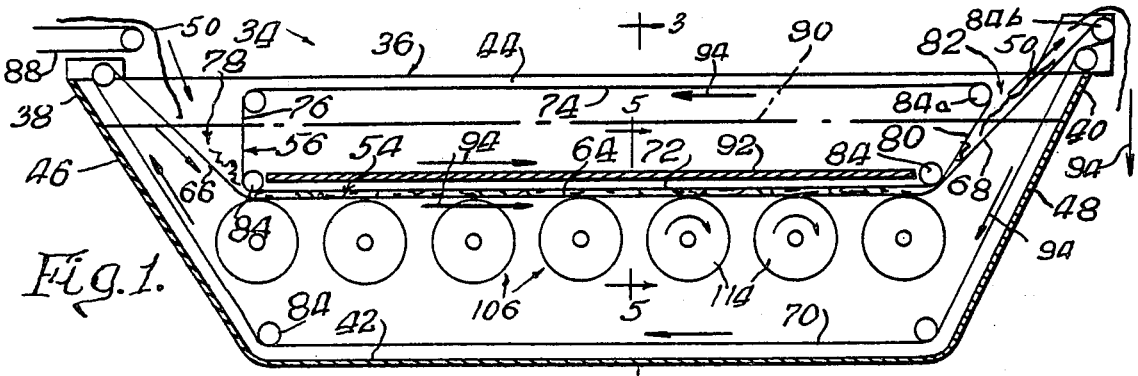
Fig. 1.
Fig. 2.
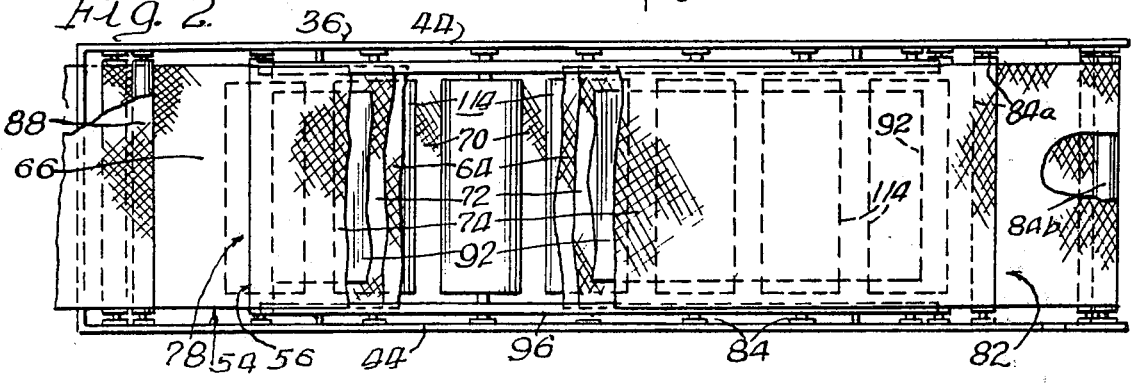
Fig. 3.
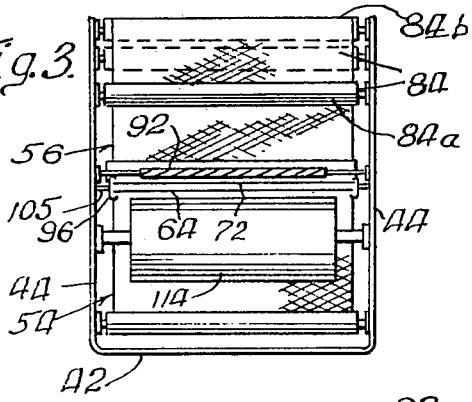
Fig. 4.
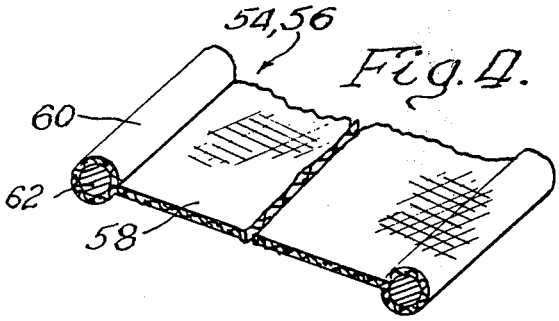
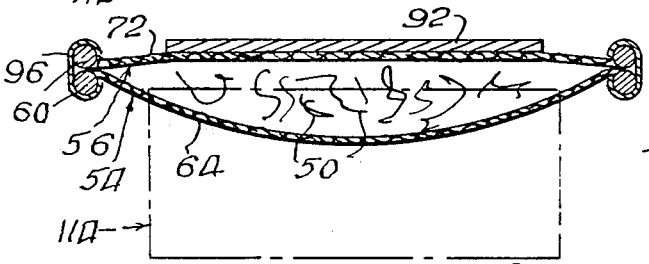
Fig. 5.
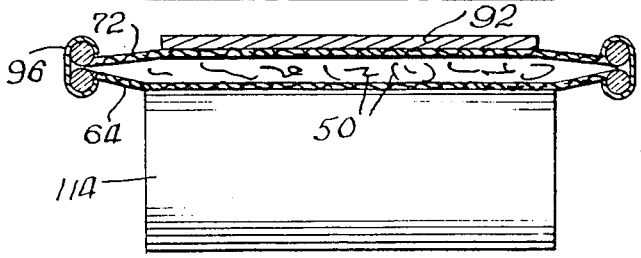
Fig. 6.

Fig. 17.
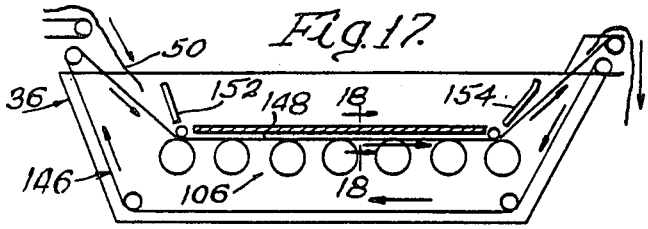
Fig. 18.
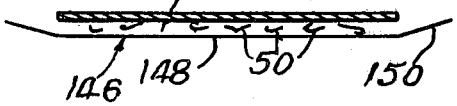
Fig. 19.
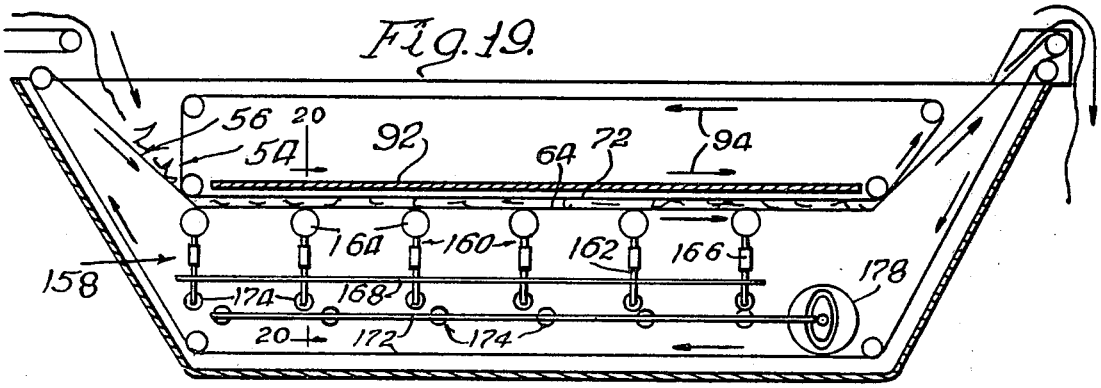
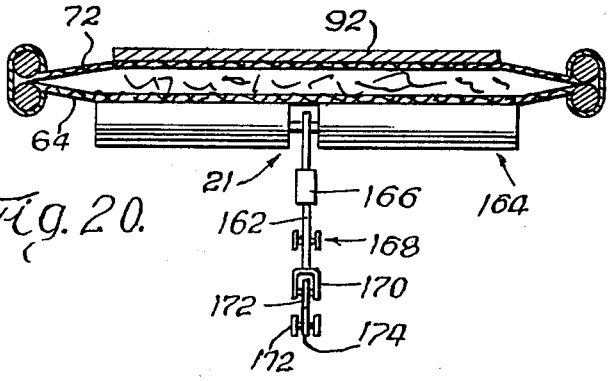
Fig. 20.
Fig. 21.
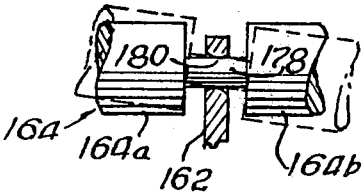
Fig. 22.
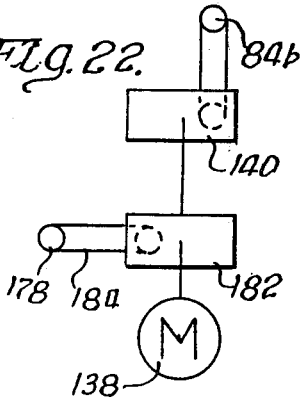
Fig. 23.
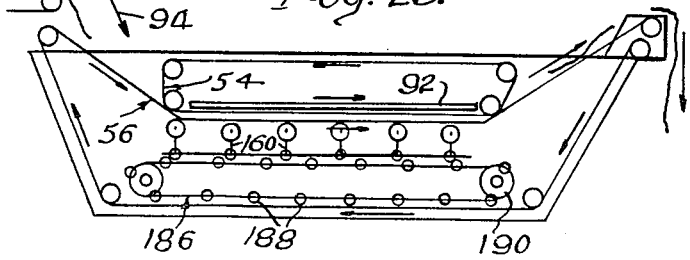

150
202
25
214
216
84b
26
88
218
196
210
212
217
60
26
204
206
36
194
208
58
192
200
25

218
58
84b
192
216
214
222
217
212
210
194
206
60
44
44
50
200
208
42

58
192
60
194

220
140
218
M
138

216
214
60
190
192
216
218
214
218

30
226
30
60
228

31
60
226
60
228
31

226
60
228

Fig. 32.
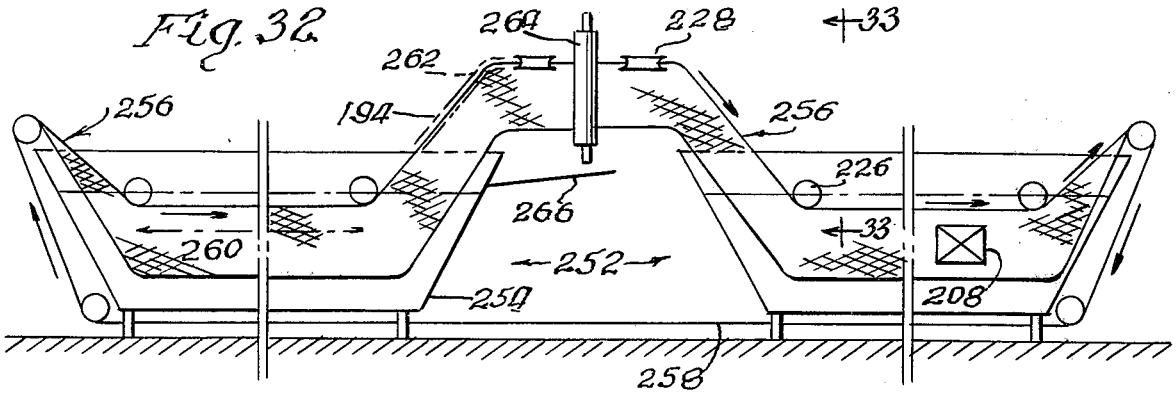
Fig. 34.
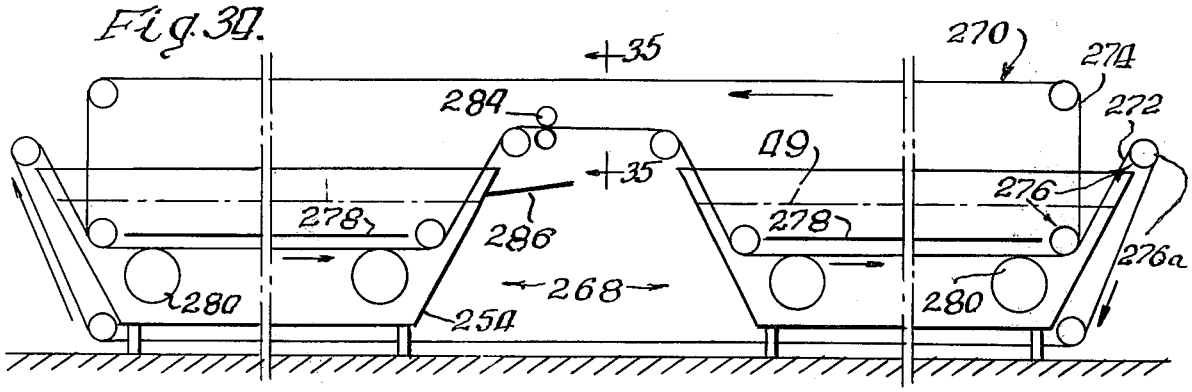
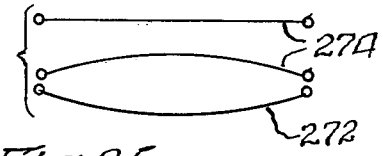
Fig. 35.
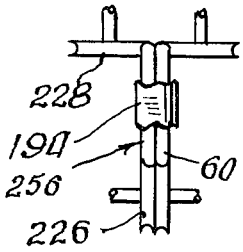
Fig. 33.

CONTINUOUS LAUNDERING METHOD

This application is a continuation-in-part of my prior and copending application, No. 141,952, filed Apr. 21, 1980, and now Patent No. 4,361,018, for Continuous Laundering.

FIELD OF THE INVENTION

A serious problem that always existed in continuous laundering is that agitation of the goods, which is considered necessary for complete laundering, renders it difficult to move the goods continuously. Continuous operation by its very nature presupposes the movement of the goods in the laundering steps, that is, in order for the laundering operation to be successful or effective, they must be moved along. Implicit is the factor that movement be controlled movement, and this further presupposes that the goods be moved along a predetermined path, because if they are not, they would be moved only randomly, and hence not continuously. Agitation by nature is the antithesis of controlled movement. Since agitation works against controlled movement, if the agitation reaches too great intensity, the controlled movement subsides or ceases, and steps must then be taken to re-establish it, and that in effect amounts to batch-type operation. It is often desireable to have the washing water move through the tank, and movement of the goods must include the possibility of moving them against the movement of the water, because if not, the goods would be moved with the water, and by the water, and hence the action of agitation would be nullified. Heretofore, as a practical matter, continuous movement and agitation of the goods were not effectively produced in the same operation.

CROSS REFERENCES

U.S. Pat. No. 4,091,645, issued May 30, 1978, to myself, covering Continuous Laundering Apparatus.

U.S. Pat. No. 4,172,302, issued Oct. 30, 1979, to myself, covering Continuous Laundering Method.

Both of the above patents derived a common parent application.

Those patents cover continuous laundering wherein the goods are positively conveyed through the apparatus, and constantly agitated while they are so conveyed, but in those instances, the conveyor and agitating means are the same instrumentality.

In the parent case from which the present case is derived in part, and in the present case, a conveyor positively carries the goods, but the agitating means is a separate instrumentality which agitates the goods in the conveyor while they are being conveyed.

OBJECTS OF THE INVENTION

A main object of the invention is to provide novel method of continuous laundering, wherein the goods to be laundered are positively carried through the apparatus, and positively agitated as they are being carried, incorporating the following novel features and advantage:

(a) Utilizing conveyor and agitating means that are separate instrumentalities, produces more effective and efficient operation.

(b) Utilizing special kinds of conveyors more positively confines the goods, and thereby more effectively handles them.

(c) A great variety of kinds of goods can be handled.

(d) A special and effective method is provided for carrying the goods being laundered between units of laundering apparatus to perform different kinds of steps in a continuous operation.

DESCRIPTION OF CERTAIN PREFERRED EMBODIMENTS

In the drawings:

FIG. 1 is a vertical longitudinal sectional view of one form of laundering apparatus embodying the features of the present invention;

FIG. 2 is a top view of the apparatus of FIG. 1;

FIG. 3 is a vertical transverse sectional view taken at line 3—3 of FIG. 1;

FIG. 4 is a fragmentary perspective view of a conveyor belt utilized in the apparatus;

FIG. 5 is a large scale view taken at line 5—5 of FIG. 1;

FIG. 6 is a view similar to FIG. 5 but with the conveyor belt runs in compressed position;

FIG. 17 is a semi-diagrammatic view of another modified form of apparatus, oriented according to FIGS. 1 and 16;

FIG. 18 is a detail view taken at line 18—18 of FIG. 17;

FIG. 19 is a longitudinal vertical sectional view of an apparatus embodying a modified form of agitating means;

FIG. 20 is a view taken at line 20—20 of FIG. 19;

FIG. 21 is an enlarged detail fragmentary view of the element at point 21 of FIG. 20, showing the mounting of the roller means for rocking movement;

FIG. 22 is a diagrammatic view of drive for the conveyor means and agitating means of FIG. 19;

FIG. 23 is a view similar to FIG. 19, but on a smaller scale, showing apparatus with another form of agitating means;

FIG. 32 is a diagrammatic side view of a multiple-unit arrangement of laundering apparatus;

FIG. 33 is a view taken at line 33—33 of FIG. 32;

FIG. 34 is a diagrammatic side view similar to FIG. 32, but of a modified form relative thereto; and FIG. 35 is a view taken at line 35—35 of FIG. 34.

Figure 7:
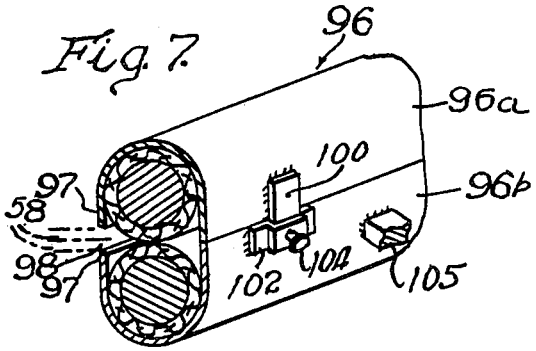
FIG. 7 is a fragmentary perspective view of a means for mounting the conveyor belts and oriented generally in the direction of FIG. 3.

As used herein laundering is a generic term covering different phases, including washing, rinsing, and similar processes.

Referring in detail to the drawings, and particularly to FIGS. 1, 2 and 3 thereof, the apparatus as a whole is indicated at 34 and includes a tank 36, having an inlet end 38 and an outlet end 40. The tank may be of any suitable construction and includes a bottom element or floor 42, side walls 44, an end wall 46 at the inlet end, and an end wall 48 at the outlet end. The tank serves as a framework for mounting other components of the apparatus described hereinbelow.

The items or goods to be laundered may be towels 50, for example, and are introduced at the inlet end by suitable means, such as a conveyor 51.

The apparatus includes conveyor means 52 made up, in the present embodiment, of a lower conveyor 54 and an upper conveyor 56, each of which is an endless blet. FIG. 4 shows a fragment of such a belt and includes a main portion or web 58 which is of openwork, or mesh, form enabling free and virtually unimpeded flow of water threrthrough. The belt at the side edges has beads or ribs 60 made up of a central core 62 of relatively incompressible material, such as cord, with the side edges of the web wrapped therearound. These beads extend the full linear length of each belt, and serve as enlargements for guiding the belt as referred to again hereinbelow.

The lower endless belt 54 has a main, horizontal top run 64, extending the main portion of the length of the tank, a downwardly inclined run 66 at the inlet end and an upwardly extending run 68 at the outlet end. The belt 54 has a return run 70 which may be within the tank.

The upper endless belt 56 has a lower main, horizontal run 72 substantially the same length of the main run 64 of the lower belt and closely adjacent thereabove. This belt 56 has a top return run 74, and a vertical run 76 adjacent the inlet end of the tank forming a V-shaped space 78 with the run 66 into which the goods are dropped; it also has an end run 80 adjacent the outlet end, inclined upwardly forming a sharp or narrow V-shaped space 82 with the run 68, the two runs 80, 68 serving to carry goods from the tank, at the outlet end.

The endless belts are mounted on suitable rollers identified generally at 84, and including one, 84*a*, for driving the upper belt, and another 84*b*, driving the lower belt. It is not essential that any particular ones of the rollers be utilized for this purpose. The drive roller 84*b* may be positioned outwardly beyond the outlet end of the tank for facilitating dropping the goods out of the tank.

The dot-dash line 90 indicates a normal level of water utilized in the laundering operation, this level being above the runs 64, 72. All of the agitating action thus takes place immersed in the water as will be understood, and the goods are conveyed in the water throughout nearly the full length of the tank.

A horizontal reaction plate 92 is mounted immediately above the runs 64, 72, which serves as a reaction member for the agitating means as referred to hereinbelow.

The conveyor belts are driven in the directions indicated by the arrows 94, and in accordance therewith the two runs 64, 72 of the two conveyor belts travel from the inlet end to the outlet end. These two runs together with the reaction plate 92 extend through and form an operating range in the laundering steps. The goods upon being dropped into the V space 78 are carried into the space between the runs 64, 72, and thus carried thereby in the direction noted. These belt runs extend transversely a substantial portion of the width of the tank (FIG. 3). One means for positioning and guiding the runs 64, 72 may take the form of channels 96 which receive the beads 60 of the belts and confine them therein, the terminal side edges 97 (FIG. 7) of the channels defining openings 98 accommodating the thickness of the two web elements, but holding the beads therein. These channels include a pair of sections, 96*a*, 96*b* which can be separated for fitting the beads of the web therein. These sections include for example a cleat 100 on one section and a loop 102 on the other, for receiving the cleat, and set screws 104 securing them together. A mounting bar is shown at 105 by which the channels are mounted on the side walls of the tank (FIG. 3).

The side edges of the two runs 64, 72 are held together so that the two runs form in effect a run that is continuous circumferentially in transverse directions, in the form of a tube, confining the goods therein. The channels 96 extend only the length of the runs 64, 72, and longitudinally beyond the channels the runs separate at the spaces 78, 82.

Figure 8:
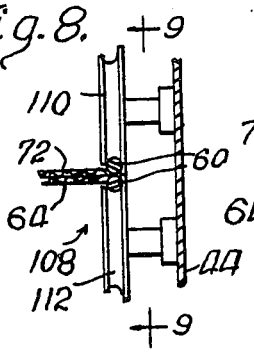
FIG. 8 is a view of a modified form of means for supporting the conveyor belts and oriented longitudinally, corresponding generally with FIG. 7.
Figure 9:
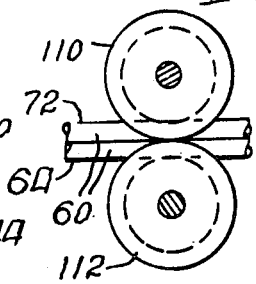
FIG. 9 is a view taken at line 9—9 of FIG. 8.

FIGS. 8 and 9 show an alternative construction for securing the side edges of the belt runs 64, 72. In these figures, the supporting means is indicated in its entirety at 108, and includes pulleys 110, 112 on axes transverse to the tank. These rollers, one above the other, have grooves receiving the beads 60 of the mesh. These pulleys are free-rotating, following the longitudinal travel of the belts, but confining the beads.

Figure 10:
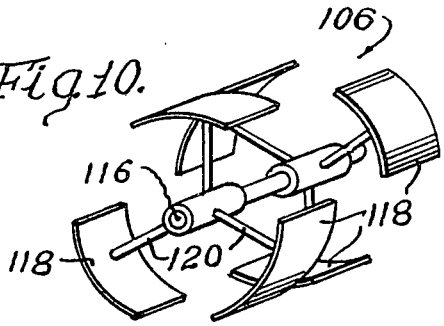
FIG. 10 is a fragmentary perspective view of one form of agitator means in the form of a roller.

Agitating means is indicated at 106 in FIG. 1 constituted by rollers disposed below the runs 64, 72, and one form thereof is shown in FIG. 10. In the laundering operation, the agitating means agitates the goods 50 between the runs 64, 72, and in doing so works upwardly against those runs, and consequently against the reaction plate 92, compressing and squeezing the goods therebetween in an effective agitating action.

Figure 13:
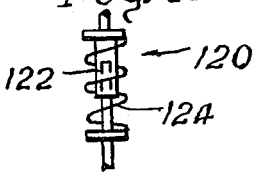
FIG. 13 is a detail view of a construction for enabling telescoping action of the arms of an agitator means.

The agitating means 106 includes, in this form, a plurality of free-rotating rollers 114, on transverse axes, extending nearly across the belts. Each roller 114 includes a shaft 116 and a plurality of peripheral elements 118 mounted on radial arms 120. The peripheral elements 118 are preferably spaced apart circumferentially, and include a plurality of groups spaced axially, with the elements of one group staggered circumferentially relative to those of the axially adjacent group. These arms 120 are preferably of telescopic construction, utilizing any convenient form such as shown in FIG. 13 which shows an arm 120 having a telescopic portion 122 carrying the peripheral element 118, the two elements being biased apart, longitudinally, by a compression spring 124. These radial arms 120 are of such length that the peripheral elements 118 are readily engaged by the lower run 64, and that run may even rest on the rollers. As the run 64 progresses, it turns the roller by friction, and the radial arms 118 in the roller are of such length that as the peripheral elements engage the lower run they move upwardly to flex the conveyor and compress or squeeze the goods against the reaction plate 92. These peripheral elements move into and out of engagement with the belt runs in repeated fashion, and each peripheral element remains in engagement only during a very short interval of time, and throughout substantially the entire period of engagement, it is moving toward and from the belt so as to provide the agitating effect.

FIGS. 5 and 6 indicate the agitating action. In these figures the goods 50 are shown between the runs 64, 72, and there is a space between the agitating rollers 114 where the lower run 64 sags, in spaced relation below the upper run 72. As the runs progress, to the next agitating roller 114, the lower run is pushed upwardly, as explained above, this condition being shown in FIG. 6. These two figures, 5 and 6, show the agitating roller 114 only diagrammatically, for simplicity. In FIG. 6, with the lower run 64 raised, the goods are relatively compressed, it being understood that the extent of compression would depend on many factors, including the thickness of the goods, and the representation of FIG. 6 includes that condition where the goods are compacted tightly.

The incorporation of a relatively large number of rollers 114 provides the agitating effect at many localized areas in the goods, and the number of rollers, and the aggregate number of peripheral elements 118 on all of the rollers together, provide agitating effect in a great number of localized, separated and spaced, areas of the goods. The positioning of the peripheral elements 118 may be such as to provide the desired agitating effect in almost any desired locations, and number of areas. The telescoping construction of the radial arms 120, as shown in FIG. 13, accommodates variations in thickness of the goods between the runs 64, 72 whereby it is not necessary to provide even-thickness distribution of the goods. The tank may be of any desired length within practical limits, with the agitating means distributed nearly the entire length of the tank.

Figure 11:
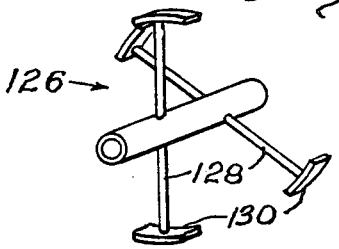
FIG. 11 is a view similar to FIG. 10 of a modified form of agitator means.

FIG. 11 shows a modified form of agitating roller, indicated at 126, which is generally similar to that of FIG. 10, but includes radial arms 128 with small peripheral elements 130 which may be of much smaller total area than the corresponding elements 118, and these may be positioned at any desired spacing, and may be as numerous as desired.

Figure 12:
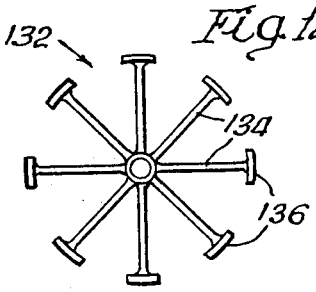
FIG. 12 is an end or axial view of another form of agitator means.

FIG. 12 is an axial view of another form of agitating roller identified as 132 having radial arms 134 with peripheral elements 136, of much smaller size, and greater number. The construction of FIG. 12 is slightly modified from that of FIG. 11, the three figures, 10, 11, and 12, showing a variety of rollers that may be adapted to different kinds of goods.

The conveyors may be driven by any suitable means, as will be understood. It is practical to drive only the lower conveyor belt 54 for example with the upper conveyor belt 56 free-running or floating. A suitable drive means is shown diagrammatically in FIG. 14 which includes a driving motor 138 operating through a drive transmission unit 140, and acting through a belt 142, driving the roller **84*b* of the lower belt. In this case, the upper belt 54 would be driven by the friction engagement with the lower belt 56**. As noted above the agitation means may be free-running, requiring no outside drive, but driven by the conveyor runs.

Figure 14:
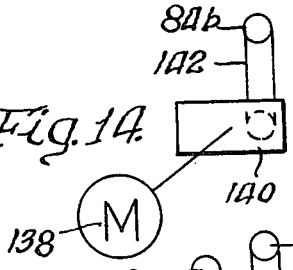
FIG. 14 is a diagrammatic illustration of the drive for the conveyor means.
Figure 15:
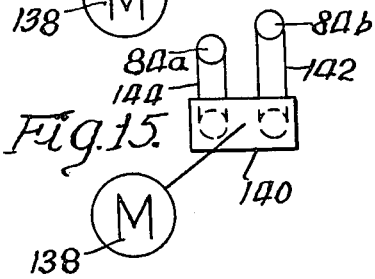
FIG. 15 is a view similar to FIG. 14 of a slightly modified form of drive means.

If it is desired to provide independent drive for each of the conveyor belts 54, 56, an arrangement shown in FIG. 15 may be utilized, this arrangement including the elements of FIG. 14, and an additional drive, operating through a belt 144 driving the roller **84*a*, identified above, which would then drive the upper belt 56. The drive transmission means 140** would of course operate to drive the two belts at the same linear speed.

Figure 16:
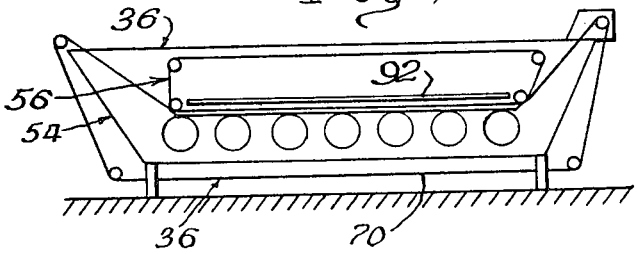
FIG. 16 is a semi-diagrammatic view of another modified form of apparatus, oriented according to FIG. 1.
Figure 24:
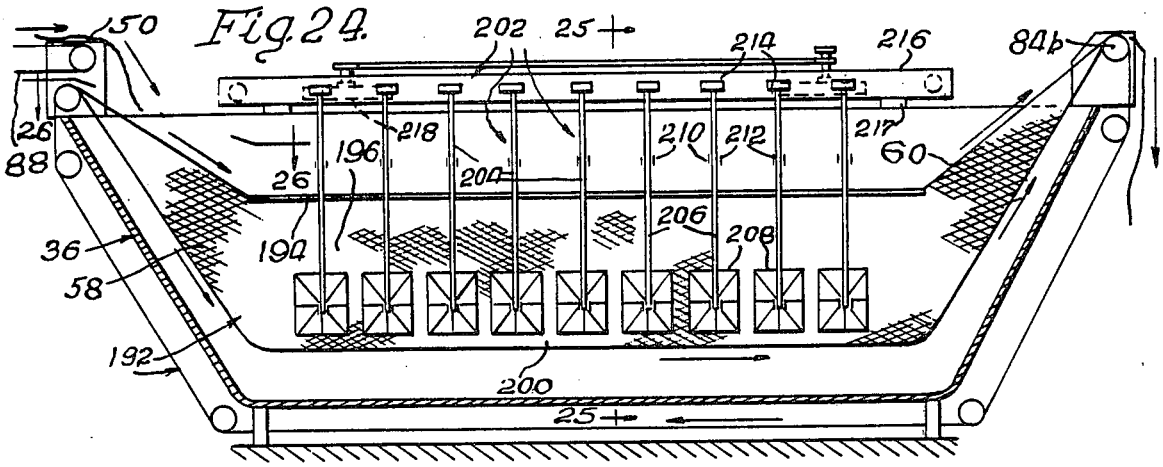
FIG. 24 is a longitudinal vertical sectional view of another form of apparatus of the invention.

FIG. 16 shows a slightly modified form of apparatus relative to the foregoing, in that the return run 70 of the lower belt 54 is disposed under the tank 36, while in the foregoing it returned within the tank. In the present instance the agitating means can be mounted directly on the floor of the tank while in the previous form they are mounted in the side walls because of the return run being in the tank.

FIGS. 17 and 18 show a further modified form of apparatus, utilizing only a single endless belt 146. In this case the main top run 148 corresponding with the run 64 is positioned directly under the reaction plate 92, and with that plate confines the goods 50 as represented in FIG. 18, the reaction plate becoming in effect a part of the conveyor means. In this form the side adge portions of the belt run are inclined upwardly slightly as indicated at 150, aiding in retaining goods in place between the belt and the reaction plate.

In this construction, FIGS. 17 and 18, guide plates 152, 154 are provided, the former guiding the goods into the space between the belt run and the reaction plate, and the latter assisting in guiding the goods in leaving at the outlet end.

FIGS. 19–21 show a modified form of agitating means. This construction includes the two belts 54, 56 and the reaction plate 92 of the first form, but instead of the agitating means 106 utilized above, a modified form 158 is utilized. The present form includes a plurality of plungers or pushers 160, each of which includes a vertical shank 162 having a roller 164, forming an agitating element, at the upper end thereof, and including a telescoping segment 166 similar to that shown in FIG. 13. The shanks 162 are mounted in suitable mounting means 168 extending longitudinally of the tank and permitting relative vertical movement of the shanks for the agitating action. The shanks at their lower end have forks 170 in which are cam follower rollers 172. The means for actuating the plungers includes a plurality of camming elements 174 preferably in the form of rollers, and mounted on a rack 176 extending longitudinally of the tank, the rack being reciprocated longitudinally by a main cam 178. Upon actuation of the main cam and consequent reciprocation of the rack, the camming elements 174 engage the cam follower rollers 172 and raise the plungers to carry the rollers 164 into agitating engagement with the runs of the conveyors in a manner similar to that described above. The rollers 164 are illustrated diagrammatically, and they may take any of various forms, including that illustrated in FIGS. 10–12. FIG. 19 shows the camming elements 174 at spacings different from the cam follower elements 172, with the result that the plungers are agitated seriatim, so as to distribute the agitating action better throughout the working area.

Preferably the rollers 164 are mounted for limited rocking movement about an axis longitudinally of the tank. This is represented in FIG. 21, where the roller 164 includes two axially spaced sections **164*a* and 164*b*** on a central shaft 177. The shaft extends through an aperture 180 in the shank 162, this aperture being of double taper shape to enable the roller to rock as indicated, this rocking action, together with the yielding telescoping accomodations of the segment 166, accommodating different thicknesses of goods at various locations.

The apparatus also includes means for driving the conveyor means and the agitating means at selectively different rates of speed. This feature of the invention is similar to a corresponding feature in my prior U.S. Pat. Nos. 4,091,645 and 4,172,302, referred to above, where the rate of conveying the goods and the rate of agitation can be independently controlled. In the present case such an arrangement is represented by FIG. 22 where the motor 138 drives the drive transmission unit 140 identified above and the roller **84*b* of the conveyor means. The present arrangement also includes a second drive transmitting unit 182 which, acting through a belt 184 drives the main cam 178 (FIG. 19). These drive transmitting units 140, 182 are independently adjustable for driving the end members, 84*b*, 178**, at the respectively different speeds.

FIG. 23 shows an apparatus similar to FIG. 19, but with a different form of agitating means. Instead of the main cam 178 and rack 176 which holds the camming members 174, of FIG. 19, the present arrangement includes an endless belt or chain 186 in which are supported camming elements 188 corresponding to the camming elements 176. The chain or belt 186 is driven by a wheel or sprocket 190, and it will be noted that the camming elements 188 are spaced linearly along the chain at a spacing different from that of the plungers 160. The plungers 160, and the remainder of the apparatus may be the same as in FIG. 19.

Attention is next directed to FIGS. 24–28, which shows another modified form of apparatus. In this form, agitating means is utilized which is similar to the instrumentality in my prior U.S. Pat. Nos. 4,091,645 and 4,172,302, referred to where it is utilized for both conveying and agitating. In the present instance the tank 36 previously described is utilized, but instead of the endless conveyors of the kind described above, a single conveyor 192 is utilized. This conveyor is an endless belt type and is similar to the conveyor belts described above in that it is of open-work mesh type material 58 with beads 60 at the side edges. The web is relatively wide and is doubled, with the beads 60 mounted in a channel 194 (FIG. 25) similar to the channel 96. The belt thus doubled, includes a depending central bag shape portion 196 in which the goods 50 are confined. The belt is trained over suitable rollers, such as the roller **84*b* identified above and another roller 198 at the inlet end. The belt is opened in flat condition in passing over these rollers (FIG. 26) and the side edges then brought in together where they are confined by the channel 194, this channel extending longitudinally of the tank the greater part of the length thereof. The belt thus, in its central portion, includes a main or operating run 200 where the goods are confined and where the agitation takes place. The goods are introduced at the inlet end by the conveyor 51, and they are delivered out of the tank over the roller 84*b*** as referred to above. The endless belt, outside of the tank, may have a return run in any convenient location, such as under the tank, as shown, over the tank, etc.

Figure 25:
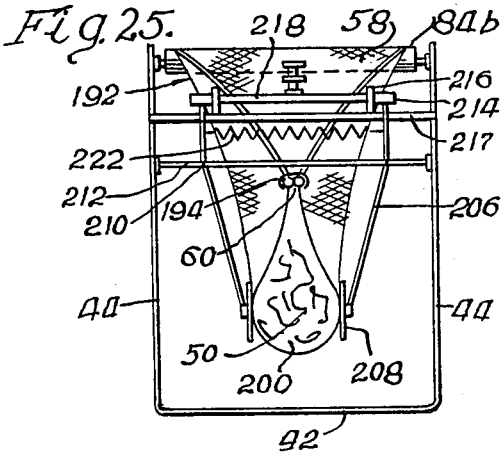
FIG. 25 is a view taken at line 25—25 of FIG. 24.
Figure 26:
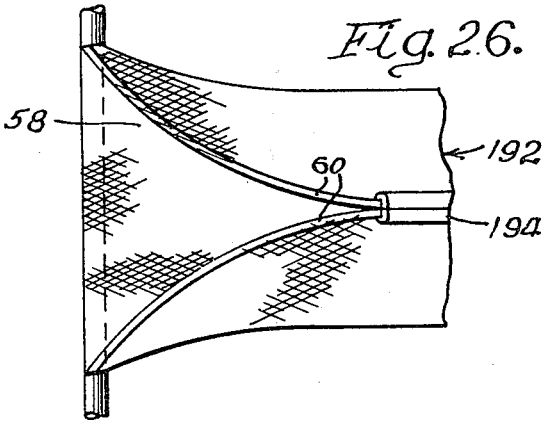
FIG. 26 is a fragmentary view on an enlarged scale taken substantially at line 26—26 of FIG. 24.
Figure 28:
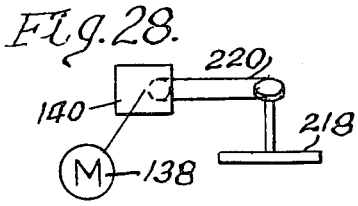
FIG. 28 is a diagrammatic view of a drive for the conveyor means and agitator means of FIGS. 24–27.
Figure 27:
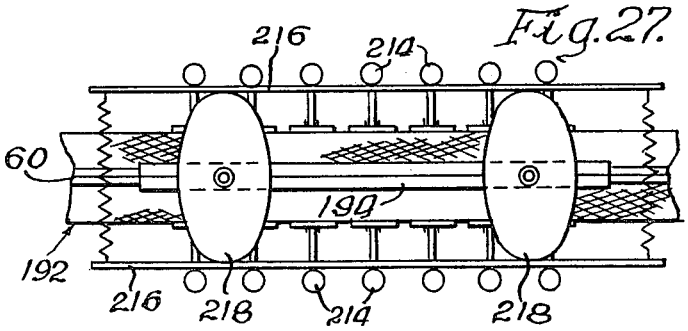
FIG. 27 is a top view of the central portion of the apparatus of FIG. 24.

In the present instance, FIGS. 24–28, the agitating means is indicated in its entirety at 202. The agitating means includes a plurality of grippers 204 each including an upright arm 206 and the gripper plate 208. The grippers are arranged in pairs with those of a pair on opposite sides of the conveyor (FIG. 25). The arms 206 are pivoted at 210 in a suitable supporting means 212 and the gripper plates 208 are pivoted in the lower ends of the arms. The arms 206 are pivoted on axes extending longitudinally of the tank and they are enabled, in their mounting, for limited rocking movement about transverse axes. The arms have cam rollers 214 at the top, which engage bars 216 extending longitudinally and spaced apart transversely. The bars 216 are supported on transverse structural pieces 217 and are moveable transversely and spread apart by a pair of longitudinally spaced cams 218 (FIGS. 25, 27) which are driven by suitable means, such as that represented in FIG. 28 which includes the driving motor 138 and drive transmitting unit 140. The latter acting through a belt 220 drives the cams 218. Upon rotation of the cams, the bars are spread, and later retracted by tension springs 222 connected therebetween. Upon swinging of the upper ends of the arms 206 outwardly, by the bars 216, the lower ends are swung inwardly, whereby the gripper plates 208 grip the central portion of the conveyor belt therebetween, and thus the goods 50 therein. This gripping action produces the desired agitation of the goods. The gripper plates 208 are preferably of open-work construction.

Upon the gripper plates 208 gripping the conveyor, and because the conveyor runs continuously, the gripper plates and the lower ends of the arms 206 must necessarily swing with the movement of the conveyor. This movement is accommodated by the limited movement, referred to above, of the arms about transverse axes. In this movement also, the follower rollers 214 roll along the bars 216.

The cams 218 may be driven in synchronism so that the bars 216 at both ends spread simultaneously, and in this case all of the all of the gripper plates 208 are moved inwardly in agitating action simultaneously. It is not necessary however that these cams act in synchronism, but may be staggered in their action.

Figure 29:
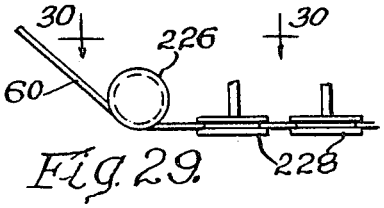
FIG. 29 is a simple view, without detail, of a modified form of guide means for the conveyor, oriented in the direction of FIG. 24, and showing elements positioned as if in the upper left hand portion of the latter figure.
Figure 30:
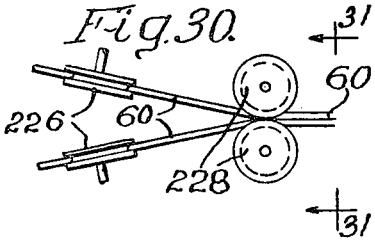
FIG. 30 is a view taken at line 30—30 of FIG. 29.
Figure 31:
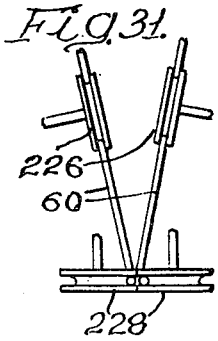
FIG. 31 is a view taken at line 31—31 of FIG. 30.

FIGS. 29–31 show alternative means for supporting the endless belt 192 in the apparatus of FIGS. 24–27. This supporting means utilizes grooved pulleys instead of the channel 194 described above. In these figures the beads 60 on the opposite side edges of the belt represent the belt. These figures also show pairs of grooved pulleys 226, 228. At the left of FIG. 29, the inclined beads 60 are disposed at the inlet end of the tank and they ride under pulleys 226, on axes which are generally transverse to the tank, but are not coaxial, as shown in FIG. 30. The beads 60 in the folding action of the belt, converge to form the V shape of FIG. 30, the pulleys 226 being positioned to accommodate that disposition of the beads. The beads then pass between the pulleys 228 which are disposed on vertical axes and positioned close together, confining the beads therebetween and holding the main run 200 thereby. The pair of rollers 228 of FIG. 29 represents a succession of such rollers of any desired number and extent, to support the main run of the belt. The rollers 228 therefore serve the same purpose as the channel 194.

As shown in FIGS. 32 and 33, a plurality of laundering units, form a combined apparatus, for successively performing laundering steps of different kinds. More than the two units shown may be used, if desired.

FIG. 32 shows two units 252 each including a tank 254 which may be identical with the tank 36. A conveyor belt 256, identical with the conveyor belt 192 except longer, is supported to run through both tanks serially, and the return run 258 is under the tanks.

The conveyor belt may be supported in the operating range 260 by either the channel 194, while at the ends pulleys 226 (as in FIGS. 29–31) guide it upwardly at the top and as the conveyor leaves the tank, curved pieces 262 of the channel 194 direct it longitudinally, and between those pieces, pulleys 228 (as in FIGS. 29–31) guide and support it. If desired, wringer rollers 264 may be utilized at a suitable location, such as between the units, and a return-run scoop 264 catches the wrung water and returns it to the first tank.

Since the conveyor belt is made up of a single piece, and it entirely encloses and supports the goods by itself, the goods are most easily carried in suspended form, between the tanks, it being impossible, from a practical standpoint, for the goods to be lost from the conveyor belt, or otherwise not effectively carried.

The method may be carried out by apparatus shown in FIGS. 34 and 35, this apparatus being a modification relative to that of FIGS. 32 and 33. In the present case two units 268 are shown, utilizing conveyor means of the kind embodied in FIGS. 1–6. The conveyor means 270 is made up of two continuous or endless belts 272, 274, the former being trained on various rollers 276, one of which 276*a* may be driven. The belt 272 dips down into each of the tanks and rises out of the first tank and continues in elevated position and then dips down into the second tank, and then again up out of the second tank and down under the two tanks in return. The belt 274 also dips down into each of the tanks and follows the course of the belt 272 throughout most of the length of the two tanks. At the ends of the tanks it rises to a position above the tanks in return. In each tank there is a reaction plate 278 above the runs of the two belts, and under these runs are a plurality of agitator rollers 280 which are driven by suitable means.

The endless belts 272, 274 are generally flat and have beads 282 at their edges, and the two belts are gripped and held by channels 194 referred to above. These channels hold the edges of the belts securely and form, in effect, a tube of the runs of the belts within the tanks and above them at the center between them. The goods 50 are shown confined between the two runs in FIG. 19. Wringer rollers 284 may be provided, and a return scoop 286 carries the water back to the first tank 268.

The channels 194 as will be understood, are shaped appropriately to carry the runs of the belt under the reaction plates, up out of the first tank, across the top, and down again into the second tank and under the reaction plate in the second tank.

In this case also as in the modification of FIGS. 32 and 33, the conveyor means, being formed into a tube, is effectively closed circumferentially, throughout the greater part of the length of the tanks together, forms an efficient and effective means for carrying the goods between the tanks in a continuous progression.

The conveyor and agitating means may be driven at selectively chosen speeds according to various factors involved, such as the toughness or fragility of the goods, the character of the soil to be removed, whether it is a washing or a rinsing operation, etc. The apparatus is adapted to different phases of laundering, such as washing, rinsing, etc., as indicated above, and in this aspect of the operation, a plurality of units of such apparatus are utilized in serial arrangement, as described, the goods passing from one unit to the next, and the rate of progression or conveying of the goods through the series of units, may be at a uniform speed. The degree of agitation in the different units may be varied, according to the factors involved as referred to, while the movement of the conveyor through the overall operation is uniform in speed.

The goods are confined in their conveyance through the apparatus and thus the operation is continuous in the strictest sense of the word. The agitation may be provided to any extent, without in any way interfering with such a conveyance of the goods. The goods are not displaced longitudinally of the belt means, at least to any great extent, or to an extent that would impede or interfere with the conveyance of the goods.

The agitating action, being spaced both along the length of the line of conveyance, and in time periods, produces an exceptionally good agitating action. The agitation takes place both in compressing the goods, and in withdrawing the agitating elements away from the goods, this action being accomplished at least partially by the general turbulence of the water which constantly tends to move the goods around, and consequently the goods after being compressed by one agitating element, are moved out of a compressed condition and again are moved into a compressed condition by the next or following agitating element.

Because of the confinement of the goods by the conveyor means, and the controlled movement of the goods along the predetermined path, they are conveyed in such path independently of the action of the water, there being no possibility of goods being displaced out of the conveyor. Another direct and immediate benefit of this feature is that the water may flow in direction opposite to the movement of the goods with a known beneficial effect.

I claim:

1. A method of laundering goods comprising the steps, conveying the goods immersed in and through water in a tank, and confining them in a predetermined path by means other than the tank, and so confining them in such manner as to enable water to pass into and out of them virtually unrestrictedly, and agitating the goods while they are so conveyed and confined, by imposing force against the goods from one side thereof and providing a physical reaction on the opposite side against the force, and moving the force a substantial distance relative to the thickness of the goods so as to compact the goods against the reaction, and so imposing the force, and reaction, intermittently and repeatedly and at speed intervals along the path and withdrawing the force after each such imposition, and thereby rendering the periods of such imposition of momentary extent.

2. A method according to claim 1 and including the step, so agitating the goods at locations spaced apart and distributed effectively throughout the extent of their conveyance through the water.

3. A method according to claim 1 and including the step, producing the agitating step as an operative result of the conveying act.

4. A method according to claim 1 and including the step, utilizing a plurality of tanks, performing a laundering step in each tank, and conveying the goods between the tanks by enclosing them in a conveyor means, and, wringing the goods, by compressing the conveyor means with the goods confined therein, at a position between the tanks.

5. A method according to claim 4 and including the step, performing different kinds of laundering steps in different tanks.

6. A method according to claim 1 and including the steps, utilizing a plurality of tanks performing a different kind of laundering step in each tank, confining the goods in a conveyor and conveying them continuously through the tanks and between the tanks, and wringing the goods at positions between adjacent tanks, while the goods are confined and in the process of continuously conveying them.

7. A method of laundering goods comprising the steps, conveying the goods immersed in and through water in a tank, and confining them in a predetermined path by means other than the tank, so conveying them by an open-work mesh belt, and completely surrounding the goods by the belt and confining them therein against escape throughout the extent of their conveyance through the water, and agitating the goods while they are so conveyed, surrounded and confined, whereby to continue to convey the goods regularly despite the agitation.

8. A method according to claim 7 and including the step, positioning the belt in open and flat position at an inlet position relative to the conveyance through the water for introduction of the goods into the belt, and at an outlet position for delivering the goods out of the belt.

* * * * *